US005823114A

United States Patent [19]

Cioletti et al.

[11] Patent Number: 5,823,114

[45] Date of Patent: Oct. 20, 1998

[54] UTILITY DISTRIBUTION SYSTEM INCORPORATING MAGNETIC LEVITATION VEHICLE GUIDEWAYS

[75] Inventors: Joseph Cioletti, Pittsburgh; Joseph Koepfinger, Coraopolis; Frank Young, Murrysville, all of Pa.

[73] Assignee: Maglev, Inc., Pittsburgh, Pa.

[21] Appl. No.: 618,057

[22] Filed: Mar. 25, 1996

[51] Int. Cl.[6] ..... E01B 25/00

[52] U.S. Cl. ..... 104/124; 191/23 R; 191/25

[58] Field of Search ..... 104/123, 124, 104/125, 126, 118, 281, 282; 191/23 R, 25, 26, 27; 52/220.1, 220.2, 220.3, 220.5, 220.7; 404/71

[56] References Cited

U.S. PATENT DOCUMENTS

| | | | |
|---|---|---|---|
| 3,859,682 | 1/1975 | Sulkiewicz | 104/124 |
| 3,919,947 | 11/1975 | Simon et al. | 104/124 |
| 3,930,451 | 1/1976 | Huebner et al. | 104/118 |
| 4,274,336 | 6/1981 | Pater et al. | 104/124 |
| 4,313,383 | 2/1982 | Parazader | 104/124 |
| 5,566,620 | 10/1996 | Siewert | 104/124 |

*Primary Examiner*—Mark Tuan Le

*Attorney, Agent, or Firm*—Reed Smith Shaw & McClay

[57] ABSTRACT

A utility transmission and distribution system includes a guideway for a magnetic levitation transportation system, and supports for supporting the guideway above the ground. The guideway includes a base connected to a structure defining an enclosed channel. At least one conduit defining an enclosed space is disposed within the channel, and is rigidly connected to the channel such that movement over the guideway remains unimpeded. At least one cable is disposed within the conduit for transmitting and distributing utilities.

4 Claims, 4 Drawing Sheets

UTILITY DISTRIBUTION SYSTEM INCORPORATING MAGNETIC LEVITATION VEHICLE GUIDEWAYS

BACKGROUND OF THE INVENTION

The present invention relates generally to utility transmission and distribution systems, and more particularly to a system to effect such distribution and transmission in conjunction with guideways for magnetic levitation vehicles and transportation systems.

Electrical wires and cables are typically suspended above the ground via a series of large, metallic towers. Such high tension wires and supporting towers are unsightly, susceptible to weather conditions, difficult and dangerous to maintain, and may be dangerous to humans due to the electromagnetic pulse that emanates from the wires. Many communities and landowners resist the installation of such towers and are apprehensive of the potential harmful effects associated with the wires and the diminished value of the land over which the high tension wires travel.

Burying the wires and cables in the ground reduces the wires' and cables' exposure to the weather and eliminates the need for unsightly towers. However, buried cables and wires are difficult to access in that they have to be uncovered by excavating the ground under which they lie. Conversely, buried wires and cables are susceptible to being damaged and severed by indiscriminate excavations by other utility services and construction workers. Additionally, land and easements must be acquired for the buried wires and cables.

In an age of increasing competitiveness in the fields of telecommunications, computer networks, and electrical power distribution; increasing public and landowner opposition to unsightly towers and potentially harmful high tension wires; and increased difficulty and costs involved in obtaining rights-of-ways and easements for utility transmission, an alternative to high tension wires and towers and buried cables is needed. In particular, in an increasingly national and global market where utility companies, including electric suppliers, wish to supply services to people and companies outside of their local geographic area, a means to convey energy, signals, and communications cross-country without having to install high tension wires and buried cables across long distances is desired.

SUMMARY OF THE INVENTION

According to a first aspect of the present invention, a utility distribution system includes a guideway for use in a magnetic levitation transportation system, and supports for supporting the guideway above the ground. The guideway includes a base rigidly fixed to a structure defining an enclosed channel, at least one conduit disposed within the enclosed channel of the guideway, and a utility transmission device disposed within the conduit.

According to a second aspect of the present invention, a utility distribution system includes a guideway for use in a magnetic levitation transportation system, and supports for supporting the guideway base above the ground. The guideway includes a base rigidly fixed to a structure defining an enclosed channel, at least one conduit disposed outside the enclosed channel and a utility transmission device disposed within the conduit.

It is, therefore, an object of the present invention to provide an alternative to high tension wires and buried cables for the cross-country transmission of electrical power, signals, and communications. Installing wires and cables for the transmission and distribution of electricity, signals, and communications along and/or inside of guideways for magnetic levitation vehicles provides an opportunity to protect the wires and cables from extreme weather conditions and errant excavations without having to go through the costly process of procuring land and easements and erecting towers or excavating ditches because the land for the guideways will already have been acquired. Additionally, the mutual benefits and opportunities of a magnetic transportation system coupled with an utility transmission distribution system will draw more public and private investment, financing, and assistance to construction of such cross-country systems and will draw less public opposition.

It is another object of the present invention to reduce maintenance costs and problems by allowing easier access to the utility transmission wires and cables while concurrently protected such cables and wires from exposure to the elements and inadvertent damage from errant excavations.

It is yet another object of the present invention to provide cheaper and more ready access to utilities for rural consumers along the guideway path than is currently provided by local utility companies. The ability of low cost utilities to transmit and distribute utilities outside of their geographic regions will lead to increased competition among utility suppliers and hence lower utility prices for utility consumers in general.

DETAILED DESCRIPTION OF THE PRESENTLY PREFERRED EMBODIMENTS

Figure 2:
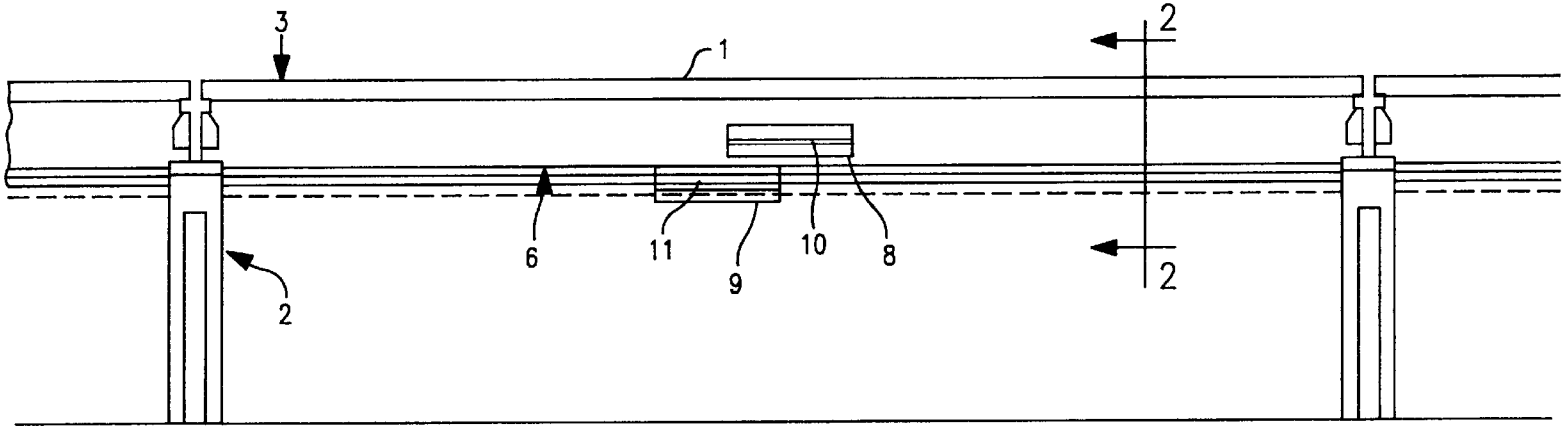
FIG. 2 is an elevational view of a magnetic levitation guideway and supports for attaching the guideway above the ground showing multiple potential locations for utility transmission devices.
Figure 1:
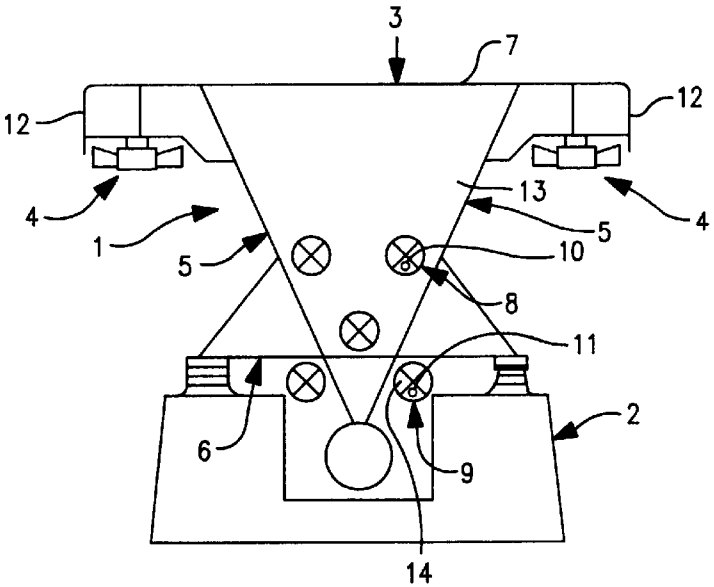
FIG. 1 is a cross-sectional view taken along line 2—2 of FIG. 2 showing multiple potential locations for utility transmission devices.

The utility distribution system of the present invention consists of a guideway 1, at least one conduit 8 disposed within the structure of the guideway or one conduit 9 disposed on the outside surface of the guideway, and a utility transmission device 10, 11 within each conduit, as depicted in FIGS. 1 and 2.

Figure 4:
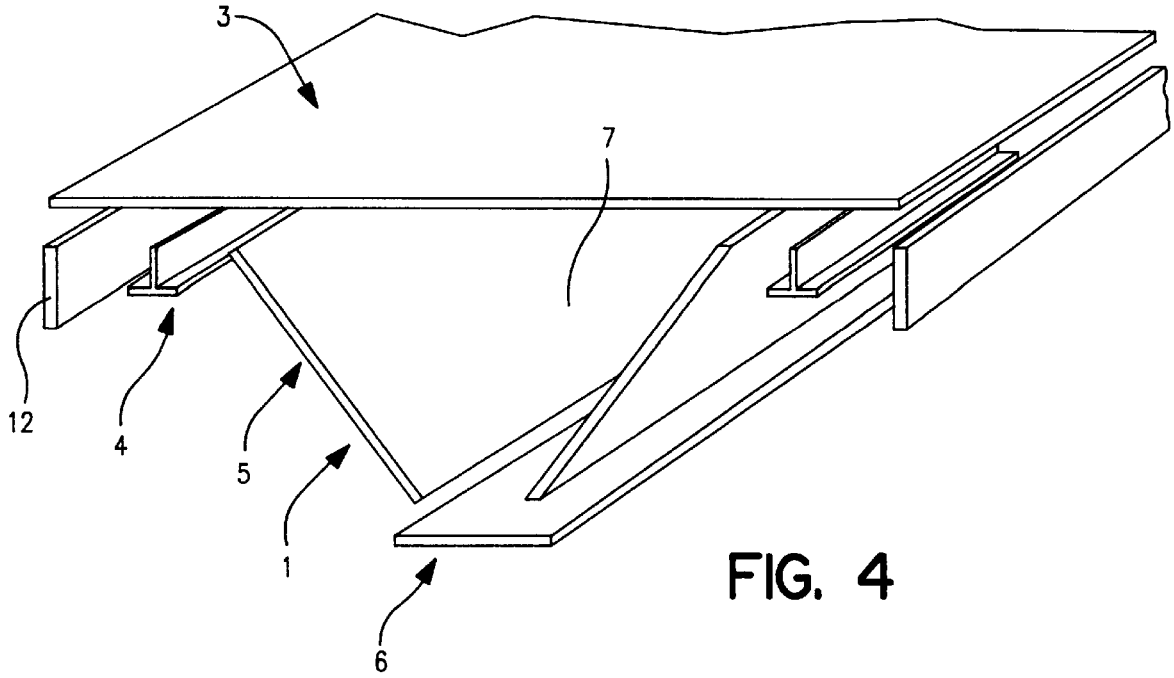
FIG. 4 is an exploded view of the components of the magnetic levitation guideway.

The guideway 1 in the preferred embodiment is constructed of steel and consists of the following elements, as best depicted in FIG. 4: a base 3 over which movement takes place, side guide rails 12 connected to either side of the base 3 and flush with the upper surface (the surface facing away from the ground) of the base 3, profiles 4 rigidly fixed to the bottom surface (the surface facing the ground) of the base 3, and two transverse flange plates 5 forming an inclined web attached fixedly between the bottom surface of the base 3 and the lower flange plate 6. The distance between the inner faces of the transverse flange plates 5 decreases from a maximum at the connection of the transverse flange plates 5 with the base 3 to a minimum at the connection of the transverse flange plates 5 with the lower flange plate 6, as best depicted in FIG. 1. In the preferred embodiment, the elements of the guideway 1 are welded together in order to provide smooth, watertight surfaces and enclosures.

The base 3, the transverse flange plates 5, and the lower flange plate 6 form an enclosed channel 7, as best depicted in FIGS. 1 and 4. The enclosed channel 7 is devoid of material, and the welded connections of the base 3, the transverse flange plates 5, and the lower flange plate 6 preferably prevent foreign material and water from entering the enclosed channel 7 from outside of the guideway.

The guideway is supported by a support 2 disposed between the lower flange plate 6 and the ground, as best depicted in FIGS. 1 and 2.

The conduits 8, 9 are preferably constructed of the same material (e.g., steel) as the guideway 1. In particular, the conduits 8, 9 are preferably constructed of the same material, or of at least material having a similar coefficient of thermal expansion as the material in the base 3, the transverse flange plates 5, and the lower flange plate 6, to allow the conduits 8, 9 to expand and contract with the guideway 1, to which the conduits 8, 9 are to be rigidly fixed, without damage to the conduits 8, 9 during fluctuations in air temperature or in the temperature of the guideway 1.

Figure 3:
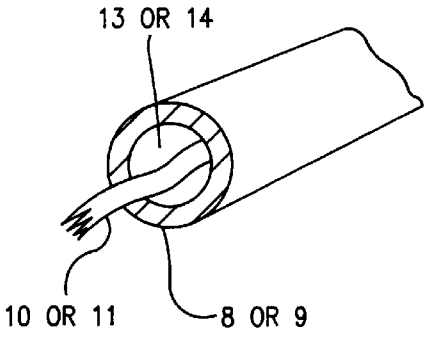
FIG. 3 is an enlarged view of the conduit and utility distribution device shown in FIG. 1.

In one aspect of the preferred embodiment, at least one conduit 8 is disposed within the enclosed channel 7 formed by the guideway 1 structure, as best depicted in FIG. 1. The at least one conduit is positioned as near to the lower flange plate 6 and as far from the base 3, over which movement takes place, as possible to eliminate any possible effects of interaction between the magnetic levitation systems moving along the guideway 1 and the utility distribution devices 10, 11. A plurality of conduits 8 may be positioned within the enclosed channel 7, as depicted best in FIG. 1. The at least one conduit 8 disposed within the enclosed channel 7 is preferably fixedly connected to the transverse flange plate 5 or the lower flange plate 6. In the preferred embodiment, the at least one conduit 8 is welded to the transverse flange plate 5 or the lower flange plate 6. In this embodiment, the at least one conduit 8 and the utility transmission device 10 disposed within the conduit 8, as depicted best in FIG. 3, are protected from the weather, animals, and human tampering by virtue of their location within the welded enclosed channel 7 formed and protected by the base 3, the transverse flange plates 5, and the lower flange plate 6. This protection, however, does result in less access to the at least one conduit 8 and the at least one utility transmission device 10 for purposes of maintenance and installation of additional utility transmission devices.

Figure 5:
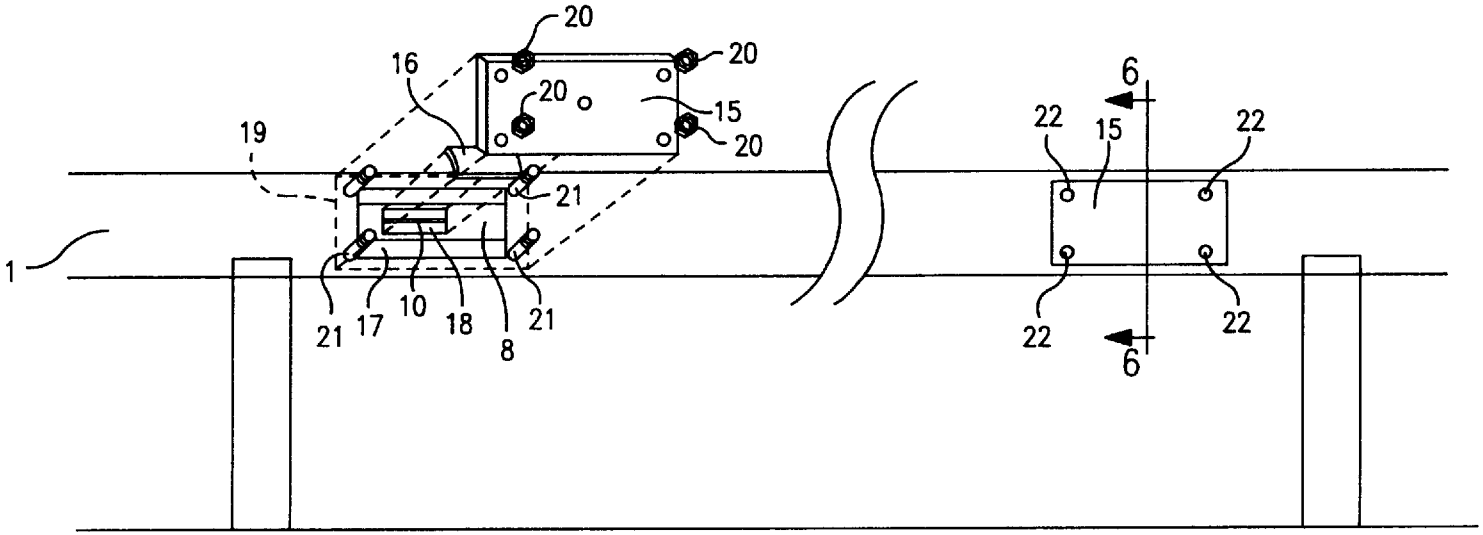
FIG. 5 is an elevational view of an access panel in the guideway and conduit shown in FIGS. 1–4.
Figure 6:
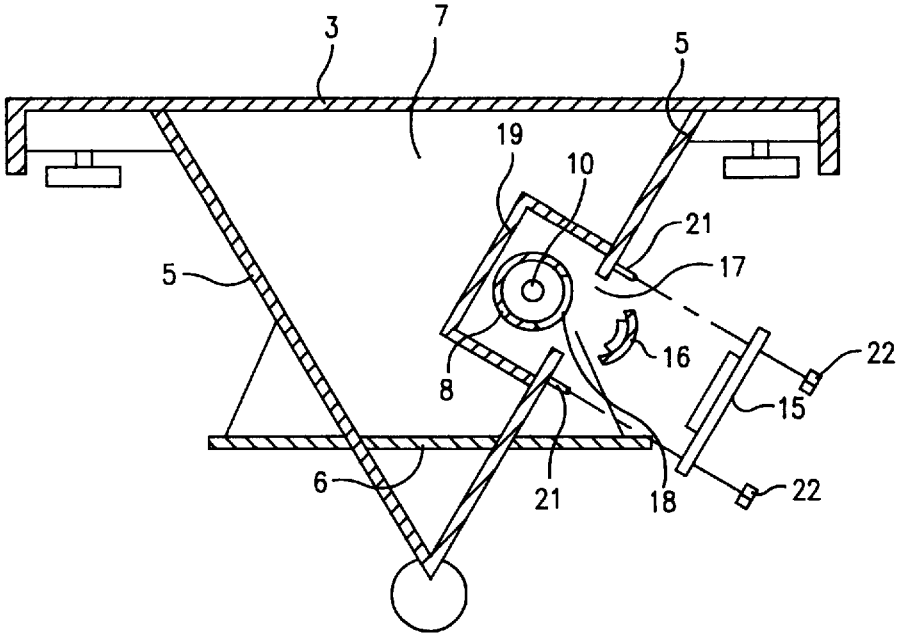
FIG. 6 is a cross-sectional view taken at the midpoint of the access panel in the guideway shown unconnected to the guideway in FIG. 5 showing the access panels in the guideway and conduit.

To provide access to said at least one conduit 8 and said at least one utility transmission device 10, at least one access panel 15 is removably connected to the transverse flange plate 5, as best depicted in FIGS. 5 and 6. In the preferred embodiment, bolts 21 are fixedly attached and protrude from the transverse flange plate 5 such that the bolts 21 slide through bolt holes 20 disposed around the outer perimeter of the at least one access panel 15 when said panel 15 is positioned to cover the opening 17 in the transverse flange plate 5. The panel 15 is secured in place over the opening 17 in the transverse flange plate 5 by nuts 22 secured to the ends of the bolts 21 protruding through the panel 15.

A structure 19, constructed of the same material as the transverse flange plate 5, is welded to the transverse flange plate 5 so as to completely seal and separate the enclosed channel 7 from the opening 17 in the transverse flange plate 5. The bolts 21 protruding from the transverse flange plate 5 are preferably outside the enclosed channel 7, as best depicted in FIG. 6. The space within the enclosed channel 7 is protected from the outside environment when the access panel 15 is removed to expose the opening in the transverse flange plate 5 by said separation effected by the structure 19.

A conduit access panel 16 is disposed along the length of the conduit 8 at locations corresponding to the access panels 15 in the transverse flange plate 5 to provide access through an opening 18 in the conduit 8 to the utility transmission device 10 for purposes of maintenance and installation of new or additional utility transmission devices, as depicted in FIGS. 5 and 6. The conduit access panel 16 covers the opening 18 in the conduit 8 and is secured in place over the opening 18 by adhesives or other means such that foreign material, including water, is unable to enter the enclosed space 13 within the conduit 8 when the conduit access panel 16 covers the opening 18 in the conduit 8.

In a second aspect of the preferred embodiment, at least one conduit would be disposed on the lower surface (closest to the ground) of the lower flange plate 6, as depicted best in FIG. 1. This eliminates the need for access panels 15 to cover openings 17 in the transverse flange plate 5 for purposes of maintenance. However, a conduit access panel 16 would still be required to cover an opening 18 in the conduit 9 (similar to the arrangement depicted in FIG. 6) to provide access to the utility transmission device 11 located within the at least one conduit 9.

In the second preferred embodiment, the at least one conduit 9 is constructed of the same material as the lower flange plate 5, or of at least material having the same coefficient of thermal expansion as the lower flange plate 5, to account for thermal expansion of the lower flange plate 5 and conduit 9. In the second preferred embodiment, the at least one conduit 9 is preferably welded to the bottom surface of the lower flange plate 6.

In all preferred embodiments, at least one utility transmission device 10, 11 is disposed within the space 13, 14 defined by the at least one conduit 8, 9, as depicted in FIG. 3. In the preferred embodiment, the at least one utility transmission device is not connected to the conduit 8, 9 and is free to move within the enclosed space 13, 14 defined within the conduit 8, 9.

In one preferred embodiment, the at least one utility transmission device 10, 11 is an electrical wire for cross-country transmission of electricity along the guideway 1. The utility transmission device 10, 11 can be any wire, cable, fiber-optic cable, or filament that is used to carry any form of electrical, electronic, optical, wave, pulse, sound, or similar transmission. The term utility includes but is not limited to electrical power, telephone communications, cable TV transmissions, electronic communications, computer communications, and any form of energy transmission.

The embodiments described above are to be considered in all respects only as illustrative and not restrictive. The scope of the invention is indicated by the following claims rather than the foregoing description. All changes which come within the meaning and range of equivalency of the claims are to be embraced within their scope.

What is claimed is:

1. In combination with a single track magnetic levitation guideway comprising a cover plate to which side guide rails and profiles are connected, transverse flange plates forming an inclined web connected to the lower surface of said coverplate and connected to the upper surface of a lower flange plate supported above the ground such that said cover plate, said transverse flange plates and said lower flange plate define an enclosed channel, a system for the distribution and transmission of electrical transmissions, fiber optic signals, cable television signals, and communication signals comprising:

at least one tubular conduit defining an enclosed space disposed within the enclosed channel defined by the cover plate, transverse flange plates and lower flange plate such that the at least one tubular conduit is oriented with its long axis parallel to the long axis of the cover plate of the guideway; and at least one cable for transmitting electricity is disposed within the enclosed space defined by the at least one tubular conduit.

2. The apparatus of claim 1 wherein the at least one tubular conduit is rigidly fixed to the lower flange plate such that said at least one tubular conduit is oriented with its long axis parallel to the long axis of said lower flange plate and unimpeded movement is maintained along the cover plate of the guideway, said at least one tubular conduit including at least one conduit element disposed within the enclosed channel, and said at least one tubular conduit including at least another conduit element connected to the outer surface of said lower flange plate.

3. In combination with a single track magnetic levitation guideway comprising a cover plate to which side guide rails and profiles are connected, transverse flange plates forming an inclined web connected to the lower surface of said cover plate and connected to the upper surface of a lower flange supported above the ground such that said cover plate, said transverse flange plates and said lower flange plate define an enclosed channel, a system for the distribution and transmission of electrical transmissions, fiber optic signals, cable television signals, and communication signals comprising:

at least one tubular conduit defining an enclosed space disposed outside the enclosed channel defined by the cover plate, transverse flange plates and lower flange plate and rigidly connected to said lower flange plate such that the at least one tubular conduit is oriented with its long axis parallel to the long axis of the cover plate of the guideway; and at least one cable for transmission of electricity is disposed within the enclosed space defined by the at least one tubular conduit.

4. The apparatus of claim 3 wherein the at least one tubular conduit is constructed of material with a coefficient of thermal expansion similar to the coefficient of thermal expansion of the cover plate, inclined web transverse flange plates, and lower flange plate.

* * * * *